US008402570B2

(12) United States Patent
Frey

(10) Patent No.: US 8,402,570 B2
(45) Date of Patent: Mar. 26, 2013

(54) DISCHARGE DEVICE, IN PARTICULAR TOILET FLUSHER, HAVING A TANK THAT CAN BE COUPLED

(75) Inventor: Daniel Frey, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/211,492

(22) Filed: Aug. 17, 2011

(65) Prior Publication Data

US 2011/0296598 A1 Dec. 8, 2011

Related U.S. Application Data

(63) Continuation of application No. PCT/EP2010/000560, filed on Jan. 30, 2010.

(30) Foreign Application Priority Data

Feb. 19, 2009 (DE) ..... 10 2009 009 591

(51) Int. Cl.
*E03D 9/02* (2006.01)

(52) U.S. Cl. ..... 4/223; 4/231

(58) Field of Classification Search ..... 4/223, 224, 4/227.1, 227.6, 227.7, 231
See application file for complete search history.

(56) References Cited

U.S. PATENT DOCUMENTS

| | | | | |
|---|---|---|---|---|
| 3,953,902 | A | 5/1976 | Taylor | |
| 4,530,118 | A * | 7/1985 | Richards | 4/227.6 |
| 4,670,916 | A | 6/1987 | Bloom | |
| 2007/0204387 | A1 * | 9/2007 | Cornelius et al. | 4/223 |

FOREIGN PATENT DOCUMENTS

| | | | |
|---|---|---|---|
| DE | 19915322 | C1 | 1/2001 |
| EP | 1978168 | A1 | 10/2008 |
| JP | 01-097423 | A | 4/1989 |

OTHER PUBLICATIONS

PCT International Search Report (PCT/EP2010/000560) dated May 21, 2010.

* cited by examiner

*Primary Examiner* — Tuan N Nguyen
(74) *Attorney, Agent, or Firm* — David K. Benson

(57) ABSTRACT

A toilet freshener for releasing a preparation into a toilet bowl includes a dispenser, at least one container couplable with the dispenser for storing the preparation, a release element for releasing preparation into the toilet bowl and connected in communicating manner to the container via a line so that the bottom of the container is arranged above the release orifice of the release element in the direction of gravity, such that a difference in level is formed between the bottom of the container and the release orifice of the release element, and a pin connected to the line, which interacts with the couplable container such that, during coupling of the container with the dispenser, the pin displaces a volume of preparation in the container, whereby a pressure is produced in the container, which pressure conveys the preparation over the difference in level into the line.

5 Claims, 4 Drawing Sheets

DISCHARGE DEVICE, IN PARTICULAR TOILET FLUSHER, HAVING A TANK THAT CAN BE COUPLED

CROSS-REFERENCES TO RELATED APPLICATIONS

This is a continuation of International Application No. PCT/EP2010/000560, filed Jan. 30, 2010, which claims priority to German Patent Application No. DE 10 2009 009 591.8, filed Feb. 19, 2009, both of which are hereby incorporated by reference.

FIELD OF THE INVENTION

The present invention generally relates to a release device, and more particularly relates to a toilet freshener, with electromechanically effected release of preparations in particular into a toilet bowl.

BACKGROUND OF THE INVENTION

Accurate dispensing which is appropriate to requirements of flowable or pourable compositions is of relevance in a large number of fields of application.

Domestically, in particular, the dispensing of flowable substances is gaining in significance, this having its basis primarily in the exact dispensing, controlled according to requirements, of the corresponding active substances, whereby on the one hand the environment is protected by resource conservation and the prevention of incorrect or over-dispensing, while on the other hand the effectiveness of the active substances dispensed in this way is optimized.

The dispensing of cleaning and scenting compositions in the toilet area is currently effected primarily by "toilet fresheners". These comprise single- or multi-chamber containers, which are hung in the toilet bowl in such a way that, during the flushing process of flushing the toilet bowl with water, an active substance is released from the toilet freshener into the toilet bowl.

Such devices are known for example from EP0828902 or DE10113036.

A significant disadvantage of these toilet fresheners is that dispensing depends substantially on the respective local flow conditions in the toilet bowl during the flushing process. However, flow conditions may differ widely as a function of toilet type and the positioning of the toilet freshener in or on the toilet bowl. It may thus happen, for example, that with certain toilet types no active substance is released from the toilet freshener, since no or insufficient water flows over the toilet freshener during the flushing process and the dispensing mechanism of the toilet freshener is thus not initiated.

Also, if flush water flows as intended over a toilet freshener, this is disadvantageous insofar as the water path intended by the toilet manufacturer is disturbed, whereby the flushing performance of a toilet may be noticeably reduced.

Active substances are usually released from such toilet fresheners as a result of penetration of flush water through openings in the toilet freshener, the active substances being partially dissolved and discharged by and swept away from the toilet freshener when the flush water exits through corresponding outlet openings. Depending on how the toilet freshener is arranged in the toilet, the strength of flow through it varies due to the frequently locally very different flow conditions involved in flush water outlet from the toilet bowl rim, whereby only diffuse release of the active substances may be achieved.

Conventionally the flush water stream is influenced, as described above, by the introduction of a toilet freshener. The changed flow conditions may change the flushing behavior of the toilet markedly. Frequently the flush water stream is influenced in such a way that water is splashed upwards out of the toilet bowl, such that flush water escapes from the toilet bowl or may come into contact with the user when the toilet is used, which as a rule is regarded as unpleasant.

Moreover, a purposeful flow path in toilets is designed as an attempt to reduce the quantities of flush water used while maintaining the same or improved flushing behavior, such that any intervention in the flush water stream in toilets optimized in this way has a far greater effect on flushing behavior.

It would thus be desirable to have a toilet freshener for releasing active substances into a toilet bowl which dispenses active substances into the toilet bowl independently of the toilet flushing process.

Accordingly, it is desirable to provide an electrically operated release device, in particular a toilet freshener, having the lowest possible energy consumption or longest possible battery life.

Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
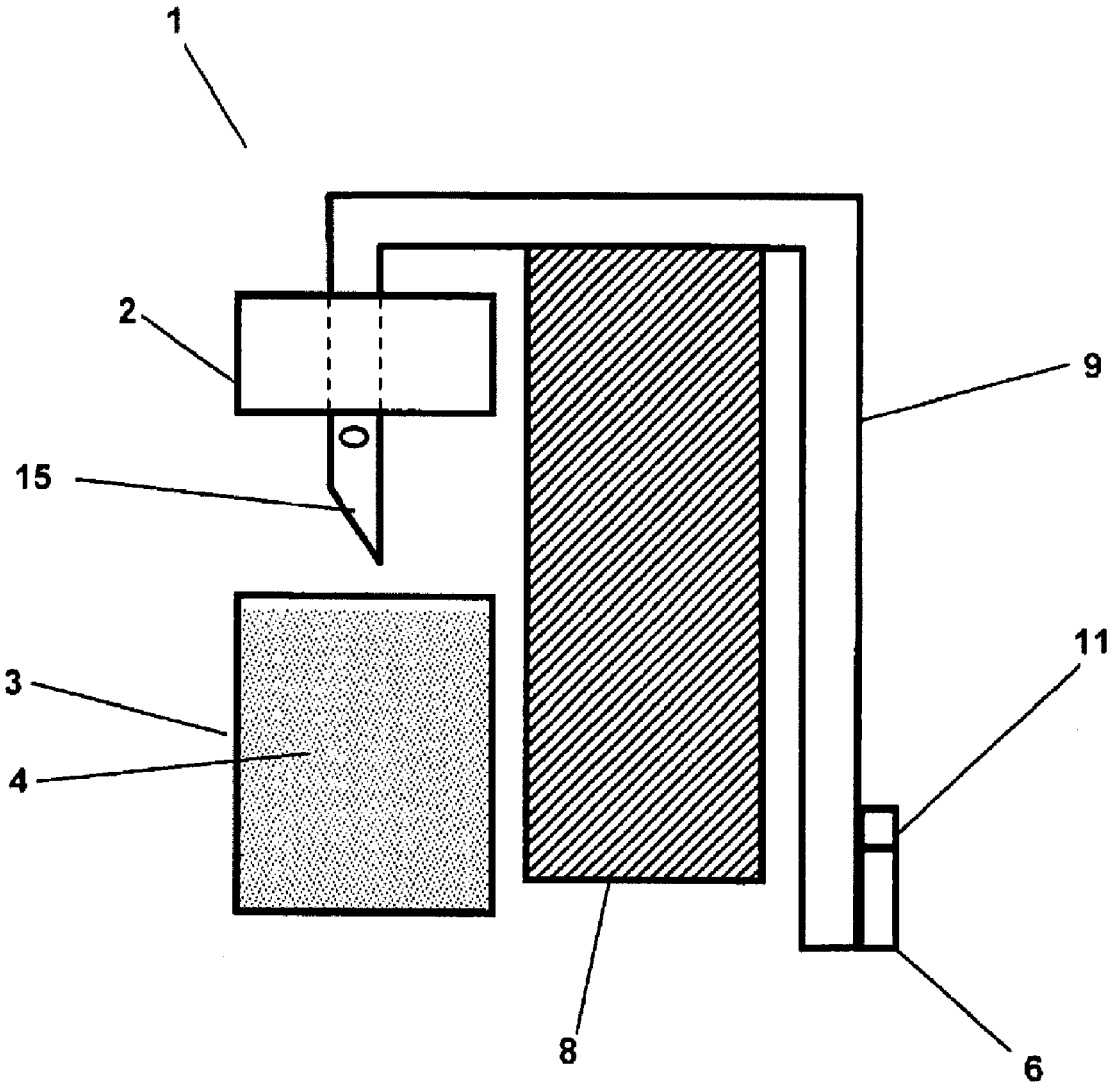
FIG. 1 is a diagram that depicts a toilet freshener with a container not yet coupled with the toilet freshener.

The following detailed description of the invention is merely exemplary in nature and is not intended to limit the invention or the application and uses of the invention. Furthermore, there is no intention to be bound by any theory presented in the preceding background of the invention or the following detailed description of the invention.

The release device according to the invention, in particular a toilet freshener for releasing at least one preparation into the interior of a toilet bowl, comprises a dispenser, at least one container couplable with the dispenser for storing at least one preparation, a release element for releasing preparation, the release element being connected in communicating manner to the container via a line and the bottom of the container being arranged above the release orifice of the release element in the direction of gravity, such that a difference in level $\Delta h$ is formed between the bottom of the container and the release orifice of the release element, the line extending, in the coupled state of container and dispenser, at least in portions in the direction of gravity above the filling level of the preparation, such that, in the flow direction of the preparation through the line, a difference in level $\Delta H$ contrary to the direction of gravity is formed, a pin connected in communicating manner to the line being arranged on the dispenser, which pin interacts with the couplable container in such a manner that, during coupling of the container with the dispenser, the pin displaces a volume Δv of preparation in the container, whereby a pressure Δp is produced in the container, which pressure conveys the preparation over the difference in level ΔH into the line.

The toilet freshener according to the invention consists of various components which may in turn be combined into assemblies. The components of the toilet freshener comprise at least one release element, a control unit, a sensor unit, an energy source, a container, a fastening means and a preparation. In a preferred embodiment of the invention, the components release element, control unit, sensor unit and energy source may be combined into a "dispenser" assembly. The components and assemblies are described below.

Dispenser

The dispenser comprises the energy source needed for operation of the toilet freshener, a control unit, a sensor unit and at least one release element.

Preferably, the dispenser consists of a housing protected from water splashing, which prevents the penetration of water splashes, as may occur when the toilet freshener according to the invention is used in a toilet bowl, into the interior of the dispenser.

It is additionally preferred for the dispenser to be arranged on the outer rim of the toilet bowl, so enabling on the one hand protection from exposure to water splashes and on the other hand convenient operation of the dispenser. In addition, with the exception of the release element, the dispenser does not project into the interior of the toilet, arrangement on the outer side of the rim thus for practical purposes not reducing the useful cross-sectional area of the toilet bowl.

Since, depending on the intended purpose, the preparations to be dispensed may have a pH value of between 2 and 12, any components of the toilet freshener which come into contact with the preparations should exhibit appropriate acid and/or alkali resistance. In addition, suitable material selection should ensure that these components are as far as possible chemically inert, for example in relation to nonionic surfactants, enzymes and/or scents.

It is particularly advantageous for the electrical components of the toilet freshener according to the invention, such as for example the energy source, the control unit and the sensor unit, to be encapsulated separately or together in such a way that the dispenser is substantially water-tight, i.e. the dispenser is thus functional even when completely surrounded by liquid. Examples of encapsulation materials which may be used are multi-component epoxide and acrylate encapsulation compounds such as methacrylate esters, urethane meth- and cyanoacrylates or two-component materials comprising polyurethanes, silicones, epoxy resins.

A significant advantage of the invention is the separation of the toilet freshener into a dispenser and a container couplable with the dispenser, whereby the toilet freshener may be used flexibly and adapted simply for the widest possible range of applications.

In a preferred development of the invention, the number of pins formed on the dispenser corresponds to the number of chambers of the container.

In a further possible embodiment, a plurality of the pins are connected to one line. This means that at least preparations from two different chambers of the container are passed via one line. It is, of course, also possible for all the pins to be connected to a single line.

In order to prevent unwanted mixing of different preparations in a line, it is advantageous, where a plurality of pins is present, for each of the pins to be connected to a separate line.

In an advantageous further development of the invention, each line is connected to a separate release element. In this manner, each preparation, or mixture of preparations, may be released separately.

Alternatively, it is also possible to connect a plurality of lines to one release element, whereby the number of release elements may be reduced.

Release Elements

Release elements are any kind of device suitable for releasing a preparation into the surrounding environment of the dispenser.

The release elements may, for example, be selected from the group of nozzles, valves, spray heads, droplet dispensers, foam spray heads, piezo elements, porous elements, wick systems, capillary systems, nebulizers, ultrasound nebulizers, ionization nebulizers etc.

Electrically controllable nozzles, valves, spray heads, droplet dispensers, foam spray heads, piezo elements and the like are in particular suitable for releasing active substances into the toilet or onto the interior surfaces of the toilet bowl.

Electrically controllable nozzles, valves, atomizers, spray heads, piezo elements, sintered plates, porous elements, wick systems and the like are in particular suitable for releasing active substance preparation into the air.

The release elements may exhibit identical or different spray cone shapes when releasing the preparations. It is accordingly for example conceivable for one release element to produce a jet with a somewhat punctiform application area, while another release element produces an extensive application field. It goes without saying that various combinations of the most varied spray cone shapes are conceivable.

In particular, the release element may be arranged in movable manner on the toilet freshener in such a manner that the user can orient the spray cone producible by the release element onto a desired application field. The release element may also comprise means which permit adjustment of the spray cone shape.

The release element may moreover provide means for electrostatic charging of active substance droplets, whereby the wetting, adhesion and/or distribution of the active substance on a surface and/or in the air is improved.

The release elements may in particular be configured such that one or more active substances are released in different directions from one another. The following table provides a list, which is however non-exhaustive, of some possible configurations with regard to the direction of release.

| Direction of release A | Direction of release B |
|---|---|
| Release of scent into toilet bowl | Release of scent into surrounding environment |
| Release of cleaning agent into toilet bowl | Release of cleaning agent under the toilet rim/during flushing or outside the flushing process |
| Release of cleaning agent into toilet bowl | Release of scent into surrounding environment |

It goes without saying that any further desired combination of the configurations shown in the above table are also possible.

It is moreover advantageous to arrange the release element in movable manner on the clip of the toilet freshener. In this way, the user can purposefully orient the release element and the spray cone of the preparation in order to wet a defined application field in or on the toilet with preparation.

The release element(s) is/are advantageously configured such that, irrespective of the positioning of the toilet freshener on the toilet bowl, a defined amount of at least one active substance preparation is released in directed and defined manner into the interior of a toilet bowl. The advantages of such a development are inter alia the more specific exposure of surfaces of the toilet bowl to one or more active substances, wherein different surfaces may be treated with active substances which differ from one another. For example, in the case of a German style flat-pan toilet, the pan may be wetted with an active substance for reducing adhesions, while an active substance for reducing lime deposits is applied onto the funnel-shaped walls extending from the pan to the rim of the toilet.

In a further, preferred embodiment of the invention the control unit generates a control signal for releasing active substance preparation when flushing is initiated and a control signal for terminating active substance release once flush water has stopped flowing through the toilet bowl.

In an advantageous further development of the toilet freshener according to the invention, the first amount released and at least the second amount released originate from identical or different active substance preparations.

According to a further embodiment which is to be preferred, the first amount released and at least the second amount released are released at different points in time.

Control Unit

A control unit for the purposes of the present application is a device which is suitable for influencing the transport of preparation, energy and/or information.

The control unit may in particular comprise a programmable microprocessor. In a particularly preferred embodiment of the invention, a plurality of dispensing programs are stored in the microprocessor which may be selected and executed depending on the container coupled to the toilet freshener. It is, of course, likewise conceivable for the dispensing programs to be manually invocable by the user.

The control unit is preferably also arranged on the outwardly directed side of the toilet bowl, from where it may straightforwardly be operated by the user, in particular when the user is sitting on the toilet.

In a particularly preferred development of the invention, the control unit may comprise a dispensing program for introducing at least two different active substance preparations into a toilet bowl or into the surrounding environment of the toilet bowl, in which at least two successive points in time $t_1$ and $t_2$ at least two different active substance preparations are released, wherein at least one active substance preparation is introduced into the interior of a toilet bowl.

A substantial advantage of such a dispensing program is inter alia optimized cleaning performance thanks to maximally exact control of possible chemical reactions due to appropriately time-offset release of the corresponding preparation or preparations, some examples of which are listed, but not exhaustively, in the following table.

| $t_1$ | $t_2$ | Advantage |
|---|---|---|
| Cleaning product in toilet bowl during flushing process | Scent in toilet bowl after flushing | Optimized scent development, since scent is released into the toilet bowl after flushing and is consequently not flushed away with the flush water. Scent is not "decomposed" by cleaning preparation. |

-continued

| $t_1$ | $t_2$ | Advantage |
|---|---|---|
| Scent in toilet bowl immediately before use | Cleaning product in toilet bowl during flushing process | Optimized scent development, since scent is released into the toilet bowl before flushing and is consequently not flushed away with the flush water. Scent is not "decomposed" by cleaning preparation. |
| Cleaning product A in toilet bowl immediately before use | Cleaning product B in toilet bowl during flushing process | Cleaning product A may prevent adhesions in the toilet bowl by a protective film of cleaning product A being applied in the toilet bowl immediately before the toilet is used, which protective film is then flushed back off the toilet surface by cleaning product B during the flushing process. |

A further advantage is that it is also possible to achieve controlled release of one or more different scents which at least reduce olfactory habituation. A procedure of cyclic and pulsed release of scent, as is known from the prior art, may be used for this purpose. Habituation may furthermore also be reduced by releasing different scents in succession.

It is also conceivable for the toilet freshener to dispense a defoamer into the toilet bowl before or during the flushing process. Excessive foaming before or during the flushing process frequently causes toilet paper to float on this foam, such that the toilet paper is not properly flushed away with the flush water, but instead floats in the toilet bowl after completion of the flushing process. Consumers often consider this unappealing. By apportioning the defoamer before or during the flushing process, excessive foaming can be prevented, so ensuring that the toilet paper is reliably flushed away. In addition or as an alternative to the defoamer, cellulose-dissolving substances may also be apportioned.

In a further, advantageous development of the invention, the release element and at least the first preparation are configured such that a foam is formed on release of the preparation into the surrounding environment.

Foaming exhibits a plurality of possible advantages. On the one hand, a foam is capable of particularly effectively trapping and minimizing malodors thanks to its pore and cell structure. On the other hand, the foam may also be applied onto the surface of the toilet bowl as an "anti-caking" coating in order to reduce adhesions of excreted metabolites to these surfaces.

Sensor Unit

The sensor unit may comprise one or more active and/or passive sensors for the qualitative and/or quantitative detection of mechanical, electrical, physical and/or chemical variables which are passed to the control unit as control signals.

In particular, the sensors of the sensor unit may be selected from the group of timers, infrared sensors, brightness sensors, temperature sensors, motion sensors, strain sensors, rotational speed sensors, proximity sensors, flow sensors, color sensors, gas sensors, vibration sensors, pressure sensors, conductivity sensors, turbidity sensors, instantaneous acoustic pressure sensors, "lab-on-a-chip" sensors, force sensors, acceleration sensors, inclination sensors, pH sensors, moisture sensors, magnetic field sensors, RFID sensors, magnetic field sensors, Hall sensors, biochips, odor sensors, hydrogen sulfide sensors and/or MEMS sensors.

In particular, a vibration sensor may be configured to pick up structure-borne noise on a toilet bowl.

In its simplest conceivable embodiment, the sensor unit may also be embodied as a toggle, pressure or momentary-contact switch.

In a further, preferred embodiment of the invention, the sensor is configured such that detection of a flushing process is achieved without significantly influencing flow conditions in a toilet bowl. Ultrasound sensors may, for example, be used for this purpose.

It is additionally advantageous for a dispensing process in which a defined amount of a preparation is released to last less than 20 seconds, preferably less than 10 seconds, particularly preferably less than 5 seconds. By providing the shortest possible dispensing period in which a preparation is released into the surrounding environment, the dispenser may rapidly be available for the next dispensing period and so ensure effective release of preparation even if a toilet is in continual use.

Energy Source

For the purposes of the present application, an energy source is taken to mean a component of the dispenser which is capable of providing energy which is suitable for autonomous operation of the dispenser.

The energy source preferably provides electrical energy. The energy source may for example comprise a battery, a mains power supply, solar cells or the like.

It is also conceivable to transmit the electrical power necessary for operating the dispenser wirelessly by means of radio waves from an appropriate transmitter to a corresponding receiver in the dispenser.

It is particularly advantageous to make the energy source interchangeable, for example in the form of a replaceable battery.

Container

For the purposes of the present application, a container is taken to mean a packaging means which is suitable for enclosing or holding preparations and which is couplable to the dispenser for releasing the preparation.

A particularly preferred arrangement is that in which two containers are provided which, further preferably, are separate from one another and in each case contain an active substance fluid. There may, however, also be a plurality of storage containers for a plurality of active substance fluids. The storage containers are separate from one another in order to prevent premature mixing of the active substance fluids. They may be physically separate or take the form of separate compartments in a single body.

The container conventionally has a capacity of <5000 ml, in particular <1000 ml, preferably <500 ml, particularly preferably <250 ml, very particularly preferably <50 ml.

The invention is in particular suitable for dimensionally stable containers such as cups, cans, cassettes, cartridges, bottles, jerricans, canisters, cartons, drums.

In particular, a container may also comprise a plurality of chambers which may be filled with different compositions. It is also conceivable for a plurality of containers to be combined into a unit, for example into a cartridge.

The following table shows examples of possible combinations of containers or chambers with the corresponding preparations for some applications.

| Container A | Container B | Container C |
|---|---|---|
| Cleaning agent | | |
| Cleaning agent | Scent | |

-continued

| Container A | Container B | Container C |
|---|---|---|
| Cleaning agent A | Cleaning agent B | |
| Cleaning agent A | Cleaning agent B | Scent |

In a particularly preferred development of the invention, the outlet orifice of the container is provided at the top of the container contrary to the direction of gravity, such that, in the service and coupled position of the container, no outflow from the outlet orifice can take place under the action of gravity. Arranging the outlet orifice on the top moreover has the advantage that, in the service position, a fluid column does not reach above the orifice, whereby the outlet orifice may more simply and reliably be sealed relative to the dispenser.

The container couplable with the toilet freshener is advantageously closed with a closing means.

In particular, the closing means interacts with the pin of the dispenser in such a manner that a seal is formed between the pin and closing means during coupling of the dispenser and container.

For the purposes of the present application, a seal comprises elements which have the function of preventing or limiting unwanted mass transfer, including pressure equalization, from one chamber to another.

The seal may in particular be a rotational and/or translational seal.

The seal may in particular be selected from the group of radial shaft sealing rings, labyrinth seals, floating ring seals, packing glands, piston rings, bellows, brush seals, axial shaft sealing rings and/or rotary transmission leadthroughs.

It is moreover preferred for the seal between pin and closing means to be configured during coupling of dispenser and container in such a manner that the overpressure $\Delta p$ arising during coupling does not escape from the container via the seal.

In a further preferred embodiment of the invention, the container comprises an RFID label which at least contains information about the contents of the container and which is readable by the sensor unit.

This information may be used in order to select a dispensing program stored in the control unit. In this way it may be ensured that the ideal dispensing program is always used for a specific preparation. It may also be provided that, in the absence of an RFID label or in the case of an RFID label with an incorrect or defective ID, the dispenser does not dispense but instead an optical or acoustic signal is produced which notifies the user of the error.

In order to prevent misuse of the containers, the containers may also comprise structural elements which interact with corresponding elements of the dispenser like a key in a lock, such that for example only containers of a particular type are couplable to the dispenser. This development furthermore makes it possible for information about the container coupled to the dispenser to be transmitted to the control unit, whereby the dispenser may be controlled in a manner adapted to the contents of the corresponding container.

In a further development of the invention, the container may be under pressure. This is of advantage in particular if the preparation is to be sprayed or released without requiring the interposition of a pump. In this case, release of the preparation may be controlled or regulated for example by a control valve which is in active connection with the control unit. This embodiment has the further advantage that no energy need be provided by the energy source for transporting the preparation, meaning that the energy source may either be made smaller or will have a longer anticipated life.

Fastening Means

The toilet freshener moreover comprises fastening means in order to fix the toilet freshener to the toilet bowl. The fastening means may for example take the form of a suction cup, adhesive tape, clip or the like.

The toilet freshener may alternatively also be fastened to the toilet cistern, the toilet seat or to the toilet lid. Fastening means sufficiently well known from the prior art may be used for this purpose.

Preparations

Preparations for the purpose of these applications are compositions which contain at least one substance from the group of cleaning agents and/or scents.

According to a further, preferred development of the invention, the preparations comprise substances for modifying surfaces, in particular ceramic surfaces.

Preparations which are suitable according to the invention are for example scent phases, in particular perfumed scent phases. Such scent phases conventionally contain at least one scent, preferably a perfume oil, at least one surfactant or an emulsifier and water and optionally further ingredients such as preservatives, thickeners, complexing agents, dyes, further surfactants, or emulsifiers, stabilizers, limescale removers etc.

Preparations which are likewise suitable according to the invention are bleach phases, in particular chlorine-containing bleach phases, preferably bleach phases based on hypochlorite, wherein, in addition to the actual bleaching agent and water, the bleach phases may conventionally optionally contain further ingredients such as thickeners, surfactants or emulsifiers, neutralizing agents, dyes, scents etc.

Further preparations which are suitable according to the invention are limescale removing active substance phases, preferably acidic limescale removing active substance phases. In addition to the actual limescale remover (which preferably comprises an organic or inorganic acid) and water, such limescale removing active substance phases may optionally contain further ingredients such as surfactants or emulsifiers, thickeners, scents, preservatives etc.

It is likewise possible to use highly concentrated surfactant phases, or "foam boosters" as they are known, as preparations. In addition to the surfactants, such highly concentrated surfactant phases may also contain still further, conventional ingredients. Such foam boosters are in particular advantageous for pretreating the toilet bowl with a carpet of foam, in order for example to prevent or reduce adhesion of excreted metabolites to the surface of the toilet and/or to trap malodors.

Preparations with an antibacterial and/or fungicidal and/or antiviral active substance phase are likewise suitable according to the invention, wherein in addition to the antibacterial and/or fungicidal and/or antiviral active substance and water, the active substance phase may optionally contain further ingredients, such as for example surfactants or emulsifiers, thickeners, scents, preservatives etc.

It is furthermore possible for the preparations to be enzyme-containing active substance phases. In addition to enzyme(s) and water, such enzyme-containing active substance phases may optionally contain further ingredients such as surfactants or emulsifiers, thickeners, scents, preservatives, etc.

It is likewise possible for the preparations used according to the invention to be absorbent, in particular odor-absorbing active substance phases. In addition to the absorbent, in particular odor absorbent, and water, said phases may optionally contain further ingredients such as surfactants or emulsifiers, thickeners, scents, preservatives etc.

According to one particular embodiment, the toilet freshener according to the invention provides the possibility of using combinations of different preparations in the storage containers, wherein according to a preferred embodiment one of the storage containers contains a scent phase, in particular as defined above.

Examples of preparation combinations to be used are a perfumed scent phase combined with chlorine bleach (not stable when stored together), perfumed scent phase with highly concentrated surfactant phase (foam boosters), scent phase with limescale removing, acidic active substance phase, scent phase with antibacterial active substance phase, various acid systems, scent phase combined with enzyme-containing active substance phase, perfumed acid phase combined with water-coloring phase, scent phase with odor-absorbing phase, perfumed acid phase with active oxygen, perfumed acid phase with active substance phase, polyacrylate-thickened etc.

High-viscosity to gel-like active substance fluids with viscosities of the order of a few thousand mPa·s, in particular from 200 to 5000 mPa·s, preferably 500 to 3500 mPa·s (measured with RotoVisko LVTV II, spindle 31, 5 rpm, 20° C.) are of particular interest here.

In a further, preferred development of the invention the preparations have a viscosity of less than 2000 mPa·s, in particular of less than 1000 mPa·s (measured with RotoVisko LVTV II, spindle 31, 5 rpm, 20° C.). Such low-viscosity to watery preparations are in particular suitable if the preparation is to be sprayed into or onto the toilet bowl.

Using low-viscosity active substance preparations in conjunction with the toilet freshener according to the invention makes it possible to achieve substantially faster and more accurate dispensing and to dispense with the use of thickening systems. Active substance systems may furthermore be used which can only be prepared in low viscosities, for example based on chlorine, HCl, etc.

EXAMPLES OF APPLICATION

In addition to use as a toilet freshener for releasing at least one preparation into the interior of a toilet bowl, it is also conceivable to use the disclosed and claimed device for releasing preparations, for example for introducing a preparation into a water-conveying domestic appliance such as for example a washing machine, dishwashing machine or washer/dryer. The application is therefore not restricted to the instance of use of the toilet freshener in a toilet, which has here been described by way of example to clarify the invention.

The invention is illustrated in greater detail below with reference to a drawing which represents merely exemplary embodiments. Particularly preferred developments and particularly preferred combinations of features are also further described in detail.

FIG. 1 shows a toilet freshener 1 with a container 3 which is not yet coupled with the toilet freshener 1.

The toilet freshener 1 comprises a dispenser 2 positioned on the outwardly directed side of the toilet bowl 8, which dispenser is connected in communicating manner via a line 9 to the release element 6 directed into the interior of the toilet bowl.

The container 3 containing a preparation 4 may be connected in communicating manner to the dispenser 2 or line 9 via the pin 15 formed on the dispenser 2. When not coupled with the container 3, the line 9 is not filled with preparation 4. In particular, when a container 3 is coupled to the dispenser 2 or line 9 for the first time, the line 9 is unfilled.

The container 3 is in particular formed from a dimensionally stable plastics material. Furthermore, on the side contrary to the direction of gravity (top side), the container 2 comprises at least one release orifice 16, from which the preparation 4 may be supplied from the container 3 to the dispenser 2 or line 9.

As may be seen in FIG. 1, in the unopened state, the volume of the container 3 is almost completely filled with preparation 4. The filling level of the container 3 with preparation 4 is preferably greater than 85%, particularly preferably greater than 90%, very particularly preferably 95%.

The coupling process between container 3 and dispenser 1 is explained in greater detail below.

Figure 2:
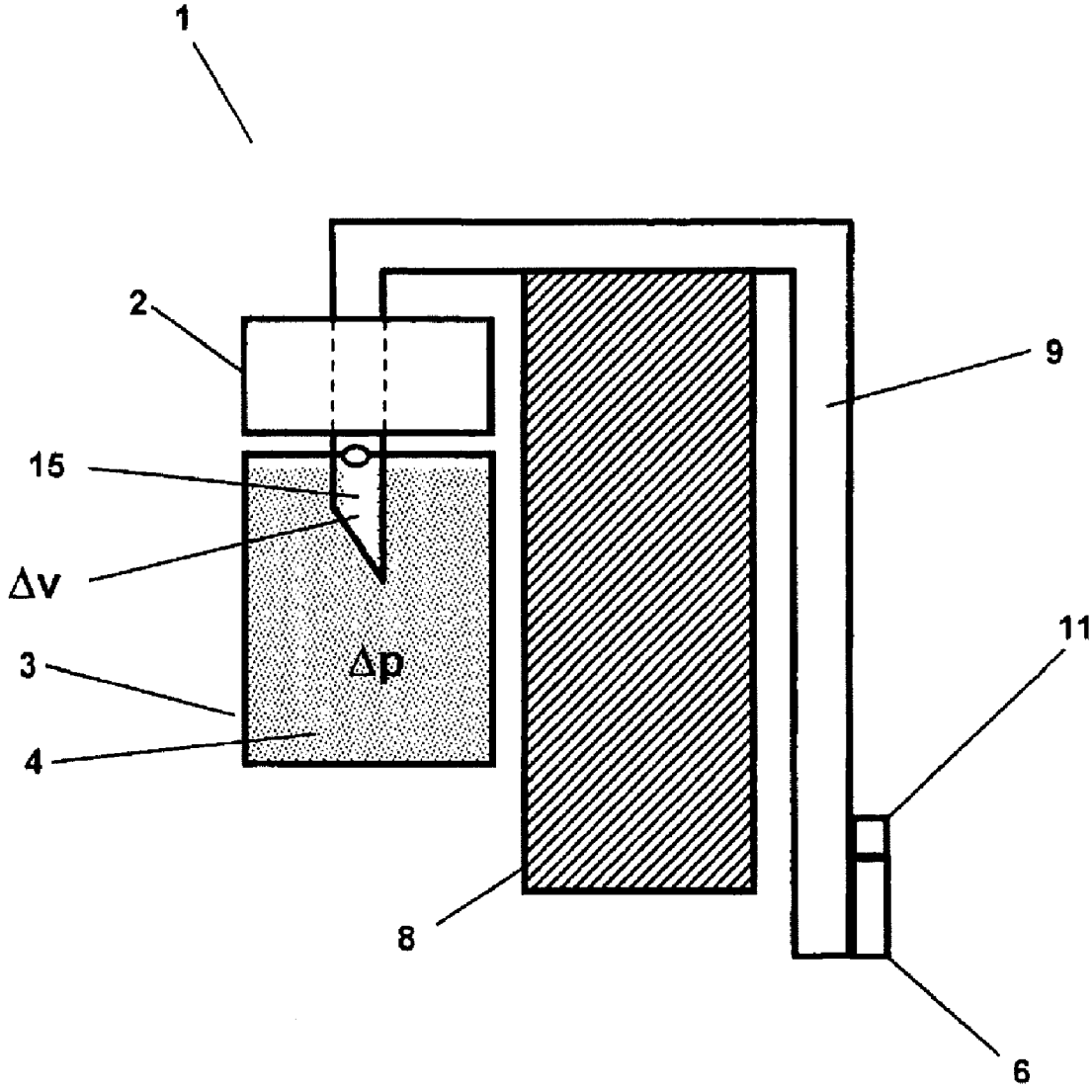
FIG. 2 is a diagram that depicts a toilet freshener with a container during the coupling process.

FIG. 2 shows the container at the start of the coupling process. During coupling of the container with the dispenser 2, the pin 15 of the dispenser 2 first of all penetrates into the container 3 and displaces therein a volume Δv, which corresponds to the volume of the penetrating pin 15. The displaced volume Δv brings about a pressure Δp in the substantially dimensionally stable container 3. At this stage of coupling, the line 9 is not yet filled with preparation 4.

The pin 15 and the release orifice 16 of the container 3 are configured such that the pressure Δp during coupling of the dispenser 2 with the container 3 cannot initially escape through the pin 15 and/or the release orifice 16.

This may be achieved, for example, by providing an orifice in the upper region of the pin 15 which is connected in communicating manner to the dispenser 2 or line 9, such that only once this orifice has entered the container 3 under pressure can the pressure escape from the container via the orifice.

Figure 4:
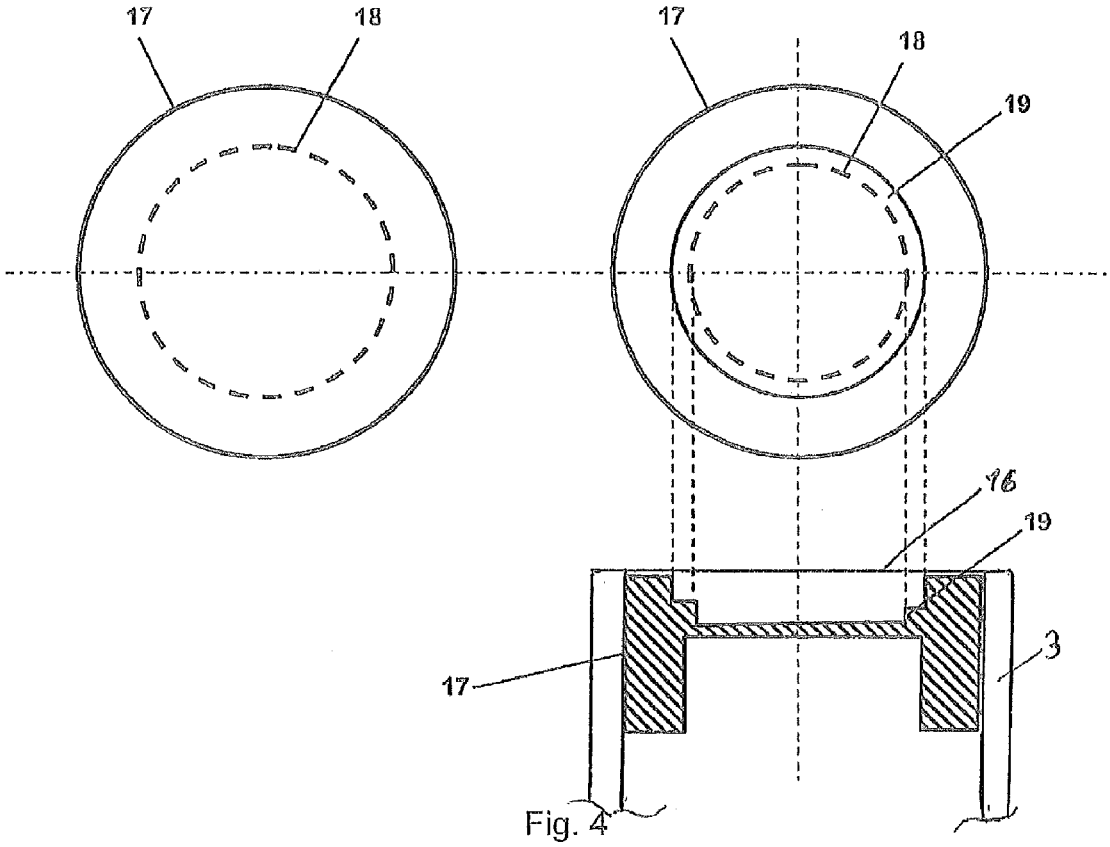
FIG. 4 is a diagram that depicts closing means of the container.

The orifice 16 of the container 3 may in particular be closed by a closing means. A closing means 17 is shown by way of example in FIG. 4. The closing means 17 should be of a construction pierceable by the pin 15. Furthermore, in the pierced state, the closing means 17 should exhibit sufficient elasticity for a maximally leak-proof connection to be created between the pin 15 and closing means 17 during coupling of the dispenser 2 and container 3.

The closing means particularly preferably takes the form of a silicone cap or silicone valve. It is furthermore conceivable for the closing means to take the form of a sealing film.

In order to facilitate coupling, the closing means 17 may comprise weakening lines 18 or weakening portions which substantially correspond to the outline of the pin 15.

Furthermore, the weakening lines 18 or weakening portions on the closing means 17 may be constructed such that, when the closing means 17 is pierced with the pin 15, an elastic sealing lip 19 is formed which presses against the external circumferential surface of the pin 15.

Figure 3:
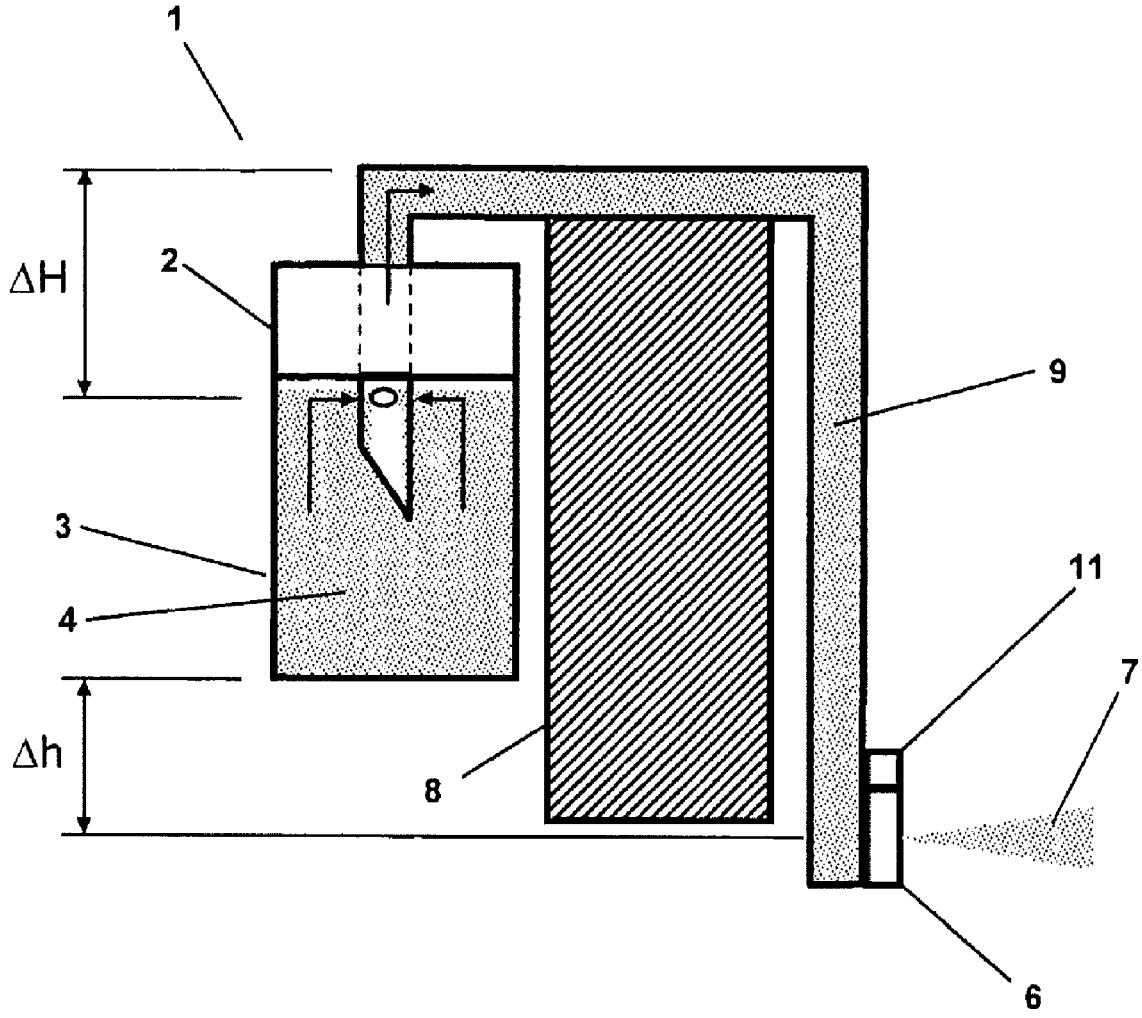
FIG. 3 is a diagram that depicts a toilet freshener with a coupled container.

FIG. 3 shows the container 3 and the dispenser 2 in the state coupled to one another, in which the bottom of the container 3 is arranged in the direction of gravity above the release orifice of the release element 6. A difference in level Δh is thus formed between the bottom of the container and the release orifice of the release element 6.

FIG. 3 furthermore reveals that, in the coupled state of container 3 and dispenser 2, the line 9 extends at least in portions in the direction of gravity above the filling level of the preparation 4, such that, in the flow direction of the preparation 4 through the line 9, a difference in level ΔH contrary to the direction of gravity (indicated by the arrow) is formed.

The pin 15 is now configured such that, during coupling of the container 3 with the dispenser 2, the pin 15 displaces a volume Δv of preparation in the container 3, whereby a pressure Δp is produced in the container 3, which pressure conveys the preparation 4 over the difference in level ΔH into the line 9.

In this manner, the line 9, in particular when a container is coupled to the dispenser 2 or the line 9 for the first time, may be completely filled with preparation by the coupling process.

As a result of the difference in level Δh between the bottom of the container and the orifice of the release element 6, the principle of communicating tubes means that preparation 4 is conveyed under the action of gravity from the container 3 to the release element 6. In this manner, it is possible to dispense with an additional pump element for conveying preparation 4 from the container 3 to the release element 6.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A release device, in particular toilet freshener, for releasing at least one preparation into the interior of a toilet bowl, comprising:

a dispenser;

at least one container couplable with the dispenser for storing at least one preparation;

a release element comprising a release orifice for releasing preparation, the release element being connected to the container via a line, the bottom of the container being arranged above the release orifice of the release element in the direction of gravity, such that a difference in level, denoted as Δh, is formed between the bottom of the container and the release orifice of the release element;

a line that couples, in a communicating manner, the release element to the container and extending, at least in portions in the direction of gravity above the filling level of the preparation, such that, in the flow direction of the preparation through the line, a difference in level, denoted as ΔH, contrary to the direction of gravity is formed; and a pin connected in communicating manner to the line being arranged on the dispenser, which pin interacts with the couplable container in such a manner that, during coupling of the container with the dispenser, the pin displaces a volume, denoted as Δv, of preparation in the container, whereby a pressure, denoted as Δp, is produced in the container due to the Δv by itself, which pressure Δp by itself conveys the preparation over the difference in level ΔH into the line.

2. The release device according to claim 1, wherein the container is closed with a closing means.

3. The release device according to claim 2, wherein the closing means interacts with the pin of the dispenser in such a manner that a seal is formed between the pin and the closing means during coupling of the dispenser and container.

4. The release device according to claim 3, wherein the seal between the pin and the closing means is formed during coupling of dispenser and container in such a manner that the overpressure Δp arising during coupling does not escape from the container via the seal.

5. A method for coupling a container with a dispenser to form a release device as set forth in claim 1, the method comprising:

arranging the pin, which is connected in communicating manner to the line, on the dispenser, coupling the container with the dispenser via the pin, wherein during coupling of the container with the dispenser, the pin displaces the volume $\Delta v$ of preparation in the container, whereby the pressure $\Delta p$ is produced in the container, which pressure conveys the preparation over the difference in the level $\Delta H$ into the line.

* * * * *